United States Patent [19]

Murphy

[11] 4,082,648

[45] Apr. 4, 1978

[54] PROCESS FOR SEPARATING SOLID ASPHALTIC FRACTION FROM HYDROCRACKED PETROLEUM FEEDSTOCK

[75] Inventor: James R. Murphy, Houston, Tex.

[73] Assignee: Pullman Incorporated, Chicago, Ill.

[21] Appl. No.: 765,141

[22] Filed: Feb. 3, 1977

[51] Int. Cl.[2] ..... C10G 31/06; C10G 31/10; C10G 13/00; C10G 23/00

[52] U.S. Cl. ..... 208/97; 208/3

[58] Field of Search ..... 208/95, 96, 97, 108

[56] References Cited

U.S. PATENT DOCUMENTS

| | | | |
|---|---|---|---|
| 3,380,910 | 4/1968 | Griffiths | 208/95 |
| 3,549,517 | 12/1970 | Lehman et al. | 208/96 |
| 3,723,297 | 3/1973 | Gatsis et al. | 208/95 |
| 3,838,038 | 9/1974 | Greenwood et al. | 208/108 |

*Primary Examiner*—George Crasanakis
*Attorney, Agent, or Firm*—C. W. Walford

[57] ABSTRACT

A pretreating process for upgrading heavy petroleum feedstocks is disclosed. In a pretreating zone, the feedstock is contacted, in the presence of hydrogen, with a cracking catalyst. In this pretreating zone, the heavy metals content of the feedstock is reduced, and a significant quantity of the feedstock coke precursors are converted directly to oils which are readily recoverable from the pretreating zone effluent. Further, some unconverted coke precursors and the heavy metals complexed therewith are separated from the pretreating zone effluent in a solid asphaltic fraction. The pretreating zone effluent remaining after separation of this solid asphaltic fraction is an upgraded feedstock having significantly reduced heavy metal, sulfur, and Conradson carbon residue contents.

12 Claims, 2 Drawing Figures

PROCESS FOR SEPARATING SOLID ASPHALTIC FRACTION FROM HYDROCRACKED PETROLEUM FEEDSTOCK

BACKGROUND OF THE INVENTION

The field of this invention is processes for upgrading petroleum feedstocks, particularly heavy feedstocks having high metal and Conradson carbon residue contents.

In refining petroleum feedstocks to intermediate or final petroleum products, the feedstocks are often subjected to one or more catalytic processes such as hydrodesulfurization, fluid catalytic cracking, heavy oil cracking, or the like. However, if heavy feedstocks are fed directly to such processes, problems can be encountered.

Heavy feedstocks are rich in coke precursors as evidenced by the typically high Conradson carbon residue content of these feedstocks. When the feedstocks are fed to the catalytic refining processes operated at elevated temperatures, an undesirably high level of coke formation occurs in the catalytic reaction zone. This coke tends to deposit on the catalyst and reduce the catalytic activity for promoting the desired reaction. In many instances, the adverse effects of the coke can be reduced to a tolerable level by periodic regeneration of the catalyst. However, excessively frequent catalyst regeneration requirements can adversely affect the economics of the catalytic refining processes to the point that they are no longer commercially acceptable for processing the heavy feedstocks.

Heavy feedstocks also typically contain high levels of heavy metals, principally vanadium and nickel. These metals are present in the heavy feedstocks in several forms including organometallic complexes such as metal prophyrins and their derivatives. If present in sufficient quantities, the metals adversely affect a wide variety of catalytic reactions including hydrodesulfurization, fluid catalytic cracking, heavy oil cracking, hydrocracking, and the like. If the feedstocks with high metal contents are passed to the catalytic reaction zone of such processes, the metals from the feedstocks deposit on the catalyst and reduce the desired catalytic activity and selectivity. The metals are themselves catalysts for dehydrogenation reactions which tend to increase hydrogen and coke formation at the expense of the desired petroleum products.

To reduce the adverse effects of the metals on the catalyst, many processes periodically withdraw catalyst from the catalyst inventory and replace the withdrawn catalyst with fresh catalyst in an effort to maintain the overall amount of metals in the catalyst inventory at a tolerable level. This replacement of catalyst keeps the total amount of metals in the reaction zone at equilibrium. The metals level in a reaction zone remains at equilibrium when the weight of metals removed by withdrawal of catalyst equals the weight of metals entering with the feedstock. The withdrawn catalyst is known as equilibrium or equilibrated catalyst, and that term is used herein to define such catalysts. Withdrawing equilibrated catalyst and replacing it with fresh catalyst is effective in many instances, especially when combined with catalyst regeneration steps. However, if the level of heavy metals in the feedstock is sufficiently high, excessively frequent catalyst replacement and regeneration rates are required and conversion of the high metal feedstocks becomes uneconomical.

A large portion of the heavy metals, coke precursors, and sulfur of heavy feedstocks are included in the asphaltic fraction of the feedstock. In particular, the metals tend to be complexed with the feedstock asphaltenes. As used herein, the term "asphaltic fraction" shall mean asphaltenes, carbenes, carboids, and closely associated resins and very heavy oils. Asphaltenes are isopentane insoluble materials which constitute a part of the asphaltic fraction. Carbenes and carboids are trichloroethylene insoluble materials which also comprise a part of the asphaltic fraction.

The asphaltenes, which are contained in the feedstock as a colloidal solution in resins, have very large molecules with fused aromatic rings, making the asphaltenes relatively difficult to convert to desired, lighter petroleum products. Conversion of the asphaltenes is made even more difficult by the fact that as they are subjected to the heat of a preliminary distillation step typical of many refining processes, the asphaltenes tend to flocculate and polymerize.

The difficulties associated with converting heavy feedstocks can be substantially reduced by utilizing a heavy oil cracking process, also known as the HOC Process. The HOC Process and its operation are well known to those skilled in the art and are described in U.S. Pat. No. 3,862,899 and "Heavy-Oil Cracking Boosts Distillates" by J. A. Finneran, J. R. Murphy and E. L. Whittington, *The Oil and Gas Journal,* Vol. 72, pp. 52–55, Jan. 14, 1974. The HOC Process differs from ordinary gas oil fluid catalytic cracking processes most notably in that the HOC Process handles feedstocks with much higher Conradson carbon residue contents than can be accommodated by gas oil FCC units and the HOC Process handles feedstocks with higher metal contents than can be accommodated by gas oil FCC units. Nevertheless, there are presently available feedstocks whose very high metal and carbon residue contents make them economically unattractive feedstocks for conversion even with the HOC Process.

Adverse supply and cost factors associated with light, easily refinable crude oils have, however, made it increasingly apparent that heavy crudes will have to be refined to satisfy the ever increasing demand for petroleum products. As a result, significant efforts have been directed to processing heavy feedstocks.

Four of the most notable processes representative of the previous efforts to process heavy feedstocks include the HOC Process described above, residual desulfurization, solvent deasphalting, and coking. Residual desulfurization is a catalytic process aimed primarily at producing low sulfur fuel oils. When high metal feedstocks are used in this process, it is sometimes necessary to initially treat the feedstock to remove metals in order to achieve acceptable catalyst life for the desulfurization process. Residual desulfurization is quite expensive, and this is one of the factors leading some skilled in the art to the conclusion that flue gas desulfurization is preferable to residual desulfurization. Solvent deasphalting, a process which uses solvents to precipitate an an asphaltic fraction and recover a better quality oil for further processing, is also quite expensive. Difficulty in handling the precipitated asphaltic fraction is also one of the drawbacks to this process. Coking, a thermal cracking process, produces a coke product which is often very high in sulfur content, and therefore, hard to market. In some cases, the coke is converted to low heating value gas by partial oxidation.

Specific illiustrative examples of efforts to process heavy feedstocks include the process disclosed in the U.S. Pat. No. 2,891,005. In that patent, high boiling oils are said to be freed of metal contaminants and compounds which form stack solids when the oils are burned. To remove the contaminants, the feed is contacted in the presence of hydrogen with a hydrogenation catalyst at a pressure of from about 400 psig to 3000 psig and at a temperature of about 750° F to about 825° F. The patent does not indicate what effect, if any, this treatment has on the boiling range of the feed. The patent does state, however, that the contaminants present in the feed form into what is termed a "micro-coke", a modified naphtha insoluble material which is separable from the hydrogenation zone effluent by filters operated at high temperatures, centrifuges, centrifugefilters, or the like. The micro-coke purportedly does not significantly foul the hydrogenation catalyst in the reaction zone; however, no mention is made of the life of the hydrogenation catalyst.

Another patent, U.S. Pat. No. 3,362,901, discloses a two-stage hydrogenation process of reduced crudes for removing a portion of the asphaltenes from the reduced crudes. In the first stage, the feedstock is contacted with either a hydrogenation catalyst or an inert material in the presence of hydrogen and at a pressure of from about 100 psig to about 2500 psig and a temperature of about 600° F to 900° F. A portion of the asphaltenes of the feedstock are said to agglomerate over the first stage catalyst in such a manner that asphaltenes are separable from the effluent of the first stage by hot filtering or by flashing off the more volatile hydrocarbon materials of the effluent. The second stage hydrogenation treatment is conducted over a more active catalyst than that of the first stage in order to achieve the desired product of the process.

Two additional patents disclose methods of processing reduced crudes which employ both hydrocracking and hydrodesulfurizations steps. U.S. Pat. No. 3,380,910 discloses a process in which a residuum is contacted in the presence of hydrogen with a hydrocracking catalyst at temperatures from about 300° C to about 550° C. After gas-liquid separation, the liquid phase of the hydrocracker effluent is subjected to atmospheric distillation and then vacuum distillation. A final liquid residual containing tars and asphaltenes is obtained from the bottom of the vacuum distillation unit and is passed to a partial oxidation process for the production of hydrogen. The lighter hydrocarbons are passed to a hydrodesulfurization unit for further processing.

In a somewhat similar manner, U.S. Pat. No. 3,825,485 discloses a process in which a petroleum feedstock is hydrocracked and then desulfurized. Feedstock is first contacted with a hydrocracking catalyst in the presence of hydrogen at a temperature of from about 750° F to about 950° F and at a pressure of between 500 psig and 5000 psig. The hydrocracking unit is operated to obtain a 25–70 percent conversion of the 1000° F plus portion of the charge stock to materials boiling below 1000° F. The effluent of the hydrocracking zone is then cooled to a suitable temperature for introduction to the second stage desulfurization zone. The patent states that since some light hydrocarbons are formed in the hydrocracking step, there may be a tendency with some feedstocks for asphalt to precipitate as a result of the temperature reduction and the presence of the lighter hydrocarbons. The patent teaches that to avoid such precipitation and the resulting plugging of the apparatus, the cooling is preferably accomplished by the addition of an aromatic rich fraction which is introduced at a temperature sufficient to effect the desired temperature reduction of the hydrocracking effluent. The subsequent mixture is then passed to the hydrodesulfurization zone for final processing.

The processes described generally and specifically above each have limitations with respect to the extent to which heavy feedstocks are upgraded by the processes or with respect to the economic attractiveness of the processes. Accordingly, there has existed a need for a process which will economically upgrade heavy feedstocks.

SUMMARY OF THE INVENTION

The present invention is a process for upgrading heavy petroleum feedstocks having at least 5 ppm metals and a Conradson carbon residue content of from about 2.0 weight percent to about 25.0 weight percent. Such a heavy feestock is conveyed to a pretreating zone in which the feedstock is contacted, in the presence of hydrogen with a cracking catalyst. As a result of the reaction in the pretreating zone, some of the heavy feedstock is converted directly to final petroleum products which are readily recoverable from the pretreating zone effluent. The majority of the effluent of the pretreating zone is a significantly upgraded feedstock having a substantially reduced metals and Conradson carbon residue content. With the present invention, this upgraded feedstock is even further upgraded by the separation therefrom of a substantially solid asphaltic fraction. The resulting treated feedstock is sufficiently low in metals and Conradson carbon residue content to be well suited for use as a feedstock for subsequent conventional refining processes such as heavy oil cracking or fluid catalytic cracking.

As stated above, a cracking catalyst is used in the pretreating zone of the present invention. This catalyst may be selected from any of the known, commercially available cracking catalysts. Such catalysts offer cost savings over the hydrogenation, hydrocracking, and exotic catalysts used with some methods for processing heavy feedstocks. In addition to fresh cracking catalysts, used or equilibrated cracking catalysts withdrawn from other refining processes may also be used in the pretreating zone to even further improve the economic benefits of the present invention.

In the pretreating zone, heavy metals, principally vanadium and nickel, are removed from the feedstock primarily by deposition of the feedstock metals on the pretreating zone catalyst. The effects of the metals deposition on the catalyst are economically controlled with the present process by catalyst regeneration which both removes the coke from the catalyst surface and restores the metal removing activity of the pretreating catalyst.

Some sulfur is also removed from the heavy feedstock in the pretreating zone. However, the severe conditions necessary for high sulfur removal are avoided. By moderating the selectivity towards sulfur removal with respect to the selectivity for hydrocracking, the hydrogen consumption in the pretreating zone is lowered while, at the same time, improved product quality is obtained.

A very significant feature of the present process is that the Conradson carbon (con carbon) content of the heavy feedstock is substantially reduced. In the pretreating zone, a significant portion of the coke precursor material present in the feedstock is converted directly to final petroleum products such as gasoline and mid-boiling range products. These products are readily recoverable from the penetrating zone effluent by fractionation or other conventional methods.

In addition, some of the coke precursors which are not fully converted to final petroleum products are separated from the pretreating zone effluent in a substantially solid asphaltic fraction. The effluent of the pretreating zone is cooled by heat exchangers or other suitable means to cause a solid asphaltic fraction to precipitate. This precipitated asphaltic fraction is separated from the effluent by simple filtration, the use of hydraulic cyclones, or other conventional means for separating liquids and solids. The asphaltenes are not normally filterable from the heavy feedstock by such physical separation methods because the asphaltenes are contained in the feedstock as a colloidal solution in resins. However, as a result of the reaction in the pretreating zone, a substantial portion of the feedstock asphaltenes precipitate with the asphaltic fraction and are removed from the feedstock by the process of the present invention. In the foregoing manner, the asphaltic fraction of the feedstock which is extremely difficult and expensive to convert by known refining processes, may be removed from the heavy feedstock and put to more economical uses. For example, the solid asphaltic fraction may be passed to a partial oxidation unit for the production of hydrogen to be used in pretreating zone of the present process.

From the foregoing, it can be seen that the process of the present invention offers many significant benefits. In addition to providing some final petroleum products, the present invention produces a greatly upgraded feedstock which is suitable for downstream processing by conventional means. By removing the metals from the feedstock, a product is formed which can be used as the feed for conventional refining processes such as heavy oil cracking or fluid catalytic cracking. The metals level is sufficiently low to reduce catalyst consumption in such downstream processes and thereby improve the economics of those processes. Similarly, the reduction in the con carbon content of the heavy feed results in improved economics of the downstream processes by reducing regeneration requirements and improving yields in the downstream processes. Therefore, the quantity of feed which must be processed in the downstream unit to obtain a given quantity of refined product is reduced and significant economic advantages are obtained.

DETAILED DESCRIPTION OF THE PREFERRED EMBODIMENT

Figure 1:
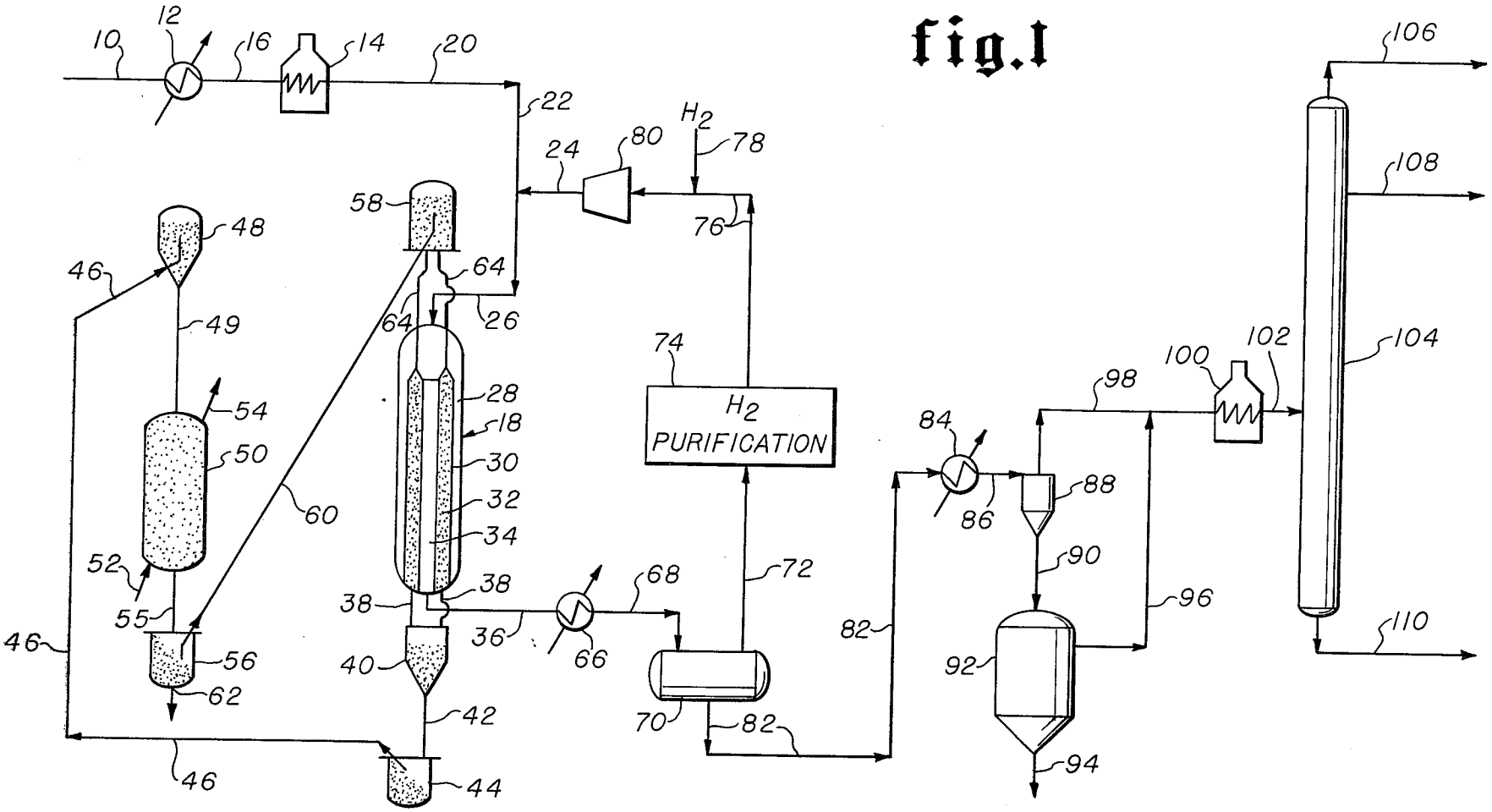
FIG. 1 is a schematic flow diagram showing the pretreating process of the present invention with common valves, fittings, gauges, and the like ommitted.

As stated above, the present invention is a pretreating process for upgrading heavy petroleum feedstocks having substantial amounts of heavy metals and high Conradson carbon residue contents. Such feedstocks include fractions with an initial boiling point in excess of 400° F. The metals content of the feedstock is more than about 5 ppm total vanadium and nickel, and it typically is on the order of 150 to 500 ppm total vanadium and nickel. In some cases, the metal content may be as high as about 700 or 800 ppm total vanadium and nickel. The Conradson carbon residue content of the feedstock may be determined by the Conradson Carbon Residue Test (ASTM D 198). The Conradson carbon residue content of the feedstocks processed by the present invention may vary from about 2.0 weight percent to about 25.0 weight percent.

The feedstocks which the present invention is particularly suited for upgrading include topped petroleum residua, either atmospheric or vacuum bottoms, heavy hydrocarbon fractions derived from deasphalting or other preliminary treatment, whole crude oils, or petroleum derived from coal, shale, or tar sands. Illustrative examples of specific feedstocks which are advantageously upgraded include Gach Saran atmospheric bottoms and Gach Saran vacuum residua. The Gach Saran atmospheric bottoms are known to contain from about 150 to about 180 ppm total vanadium and nickel, 2.5 to 3.0 weight percent sulfur, and approximately 9.4 weight percent Conradson carbon residue. Gach Saran vacuum residua sometimes contain as much as about 500 ppm total vanadium and nickel.

It is the practice of the present invention to introduce such a heavy feedstock to a pretreating zone in which the feedstock is contacted, in the presence of hydrogen, with a cracking catalyst. The pretreating zone is maintained at mild hydrocracking conditions, namely, at a temperature of from about 750° F to about 850° F and at a partial hydrogen pressure of from about 700 psig to about 3000 psig.

It has been found that in the pretreating zone a very large amount of the feedstock metals are deposited on the cracking catalyst and are thereby removed from the feedstock. Usually, around 90 to 98 percent of the metals are removed from the feedstock even with feedstock metal content as high as 700 to 800 ppm total nickel and vanadium.

Further, due to the mild hydrocracking conditions in the pretreating zone, some of the heavy molecules in the feedstock are converted to lighter hydrocarbon molecules. Indeed, some final products such as gasoline and mid-boiling range petroleum products are contained in the pretreating zone effluent. It has also been found that a significant quantity of the feedstock coke precursors are converted to recoverable oils in the pretreating zone. A reduction of 40 percent and higher in the Conradson carbon residue content of the feedstock is possible by processing the feedstock with the present invention.

It is also the practice of this invention to even further upgrade the effluent of the pretreating zone. It has been found that at least a portion of the asphaltic fraction of the heavy feedstock undergoes a desirable reaction in the pretreating zone. For example, asphaltenes are normally contained in the heavy feedstock as a colloidal solution in resins and, as a result, are not readily removable from the feedstock by simple physical procedures such as filtration. However, it has been found that when the effluent of the pretreating zone of the present invention is cooled, a solid asphaltic fraction precipitates and is separable from the effluent by conventional solid-liquid separation means. The asphaltic fraction contains asphaltenes, carboids, carbenes, and associated very heavy oils and resins. It is known that such an asphaltic fraction is extremely rich in coke precursors. In addition, some of the asphaltic fraction materials have molecular structures which are very difficult to convert in subsequent refining processes. Further, some heavy metals such as vanadium and nickel are very strongly complexed with these materials. Hence, the separation of the solid asphaltic fraction from the pretreating zone effluent further upgrades the effluent and makes it even more suitable for subsequent refining processes such as heavy oil cracking, fluid catalytic cracking, or the like.

A first embodiment of the present invention is schematically depicted in FIG. 1. The petroleum feedstock, which may be desalted and/or distilled by conventional means (not shown), enters the instant process through line 10 and usually passes through a heat exchanger 12 and on to a preheat furnace 14 via line 16. In the preheat furnace 14, the feedstock is heated to the temperature employed in the pretreating zone of a reactor 18. The temperature of the pretreating zone is in the range of about 750° F to about 850° F, but the temperature will, of course, vary according to the specific petroleum feedstock being processed. For example, a Gach Saran atmospheric residuum is preferably heated to a temperature of from about 775° F to about 825° F.

The preheated feedstock exits furnace 14 through a line 20 and is conveyed to a line 22 in which the feedstock is mixed with hydrogen entering through a line 24 at a sufficient pressure to provide the processing pressure in the pretreating zone as hereinafter described. The mixture of feedstock and hydrogen is then conveyed through line 26 to the pretreating zone reactor 18.

In the preferred embodiments of the present invention, the pretreating zone reactor 18 is a conventional moving bed reactor. The mixture of feedstock and hydrogen introduced into reactor 18 initially flows downwardly and outwardly to the reactor fluid passageways 28 exterior to the plurality of perforated catalyst cylinders 30 which support a cracking catalyst 32 in a moving bed configuration. Subsequently, the feedstock and hydrogen mixture makes it principal contact with catalyst 32 by flowing through the catalyst cylinders 30 and into the reactor's central fluid passageway 34. The treated feedstock then exits the pretreating zone reactor through line 36.

The cracking catalyst 32 with which the feedstock is contacted in the pretreating zone reactor 18 may be any conventionalcracking catalyst. For example, suitable catalysts include the commercially available acid treated clays, silica-alumina, and molecular sieve (zeolite) matrix type catalysts. It is also important to note that used or equilibrated catalyst withdrawn from other refining processes such as fluid catalyst cracking and heavy oil cracking may be utilized in the pretreating zone of the present invention. One of the advantages of uing a spent or equilibriated HOC catalyst is that the catalyst already contains some vanadium and nickel. As is known, catalysts show improved metal removing activity when they contain from about 0.5 weight percent to about 20.0 weight percent vanadium and nickel. Metals from the heavy feedstock in the pretreating zone of the present invention deposit on the catalyst 32 used in reactor 18. Accordingly, when fresh or equilibrated cracking catalyst from fluid catalystic cracking unit is used in the pretreating zone 18, the catalyst will age (i.e., gradually acquire a greater weight percentage of vanadium and nickel) to achieve its maximum metal removing activity. Alternatively, cracking catalysts which have a low metal content may be artifically impregnated with vanadium and/or nickel to improve their metal removing activity.

The cracking catalyst 32 in the pretreating zone may be in any form compatible with the type or reactor employed for the pretreating zone. For example, trickle bed, ebulated bed, moving bed, or slurry reactors may be utilized for the pretreating zone. The catalyst may be extruded, pelletized, tableted, or fluid (i.e., powdered) in form. Especially when used or equilibrated catalysts are employed in the pretreating zone in extruded, pelletized, or tableted form, it may be desirable to include an adhesive or bonding agent in the catalyst to improve the catalyst's physical strength. In the preferred embodiments of the present invention illustrated in FIGS. 1 and 2 herein, the catalyst is in an extruded form and a moving bed reactor is used.

During the operation of the process of the present invention, both metals and carbon deposit on the cracking catalyst 32 utilized in reactor 18. Accordingly, it is beneficial to regenerate the catalyst 32 to remove the carbon deposited on its surface and to reactivate the metal removing activity of the catalyst.

Figure 2:
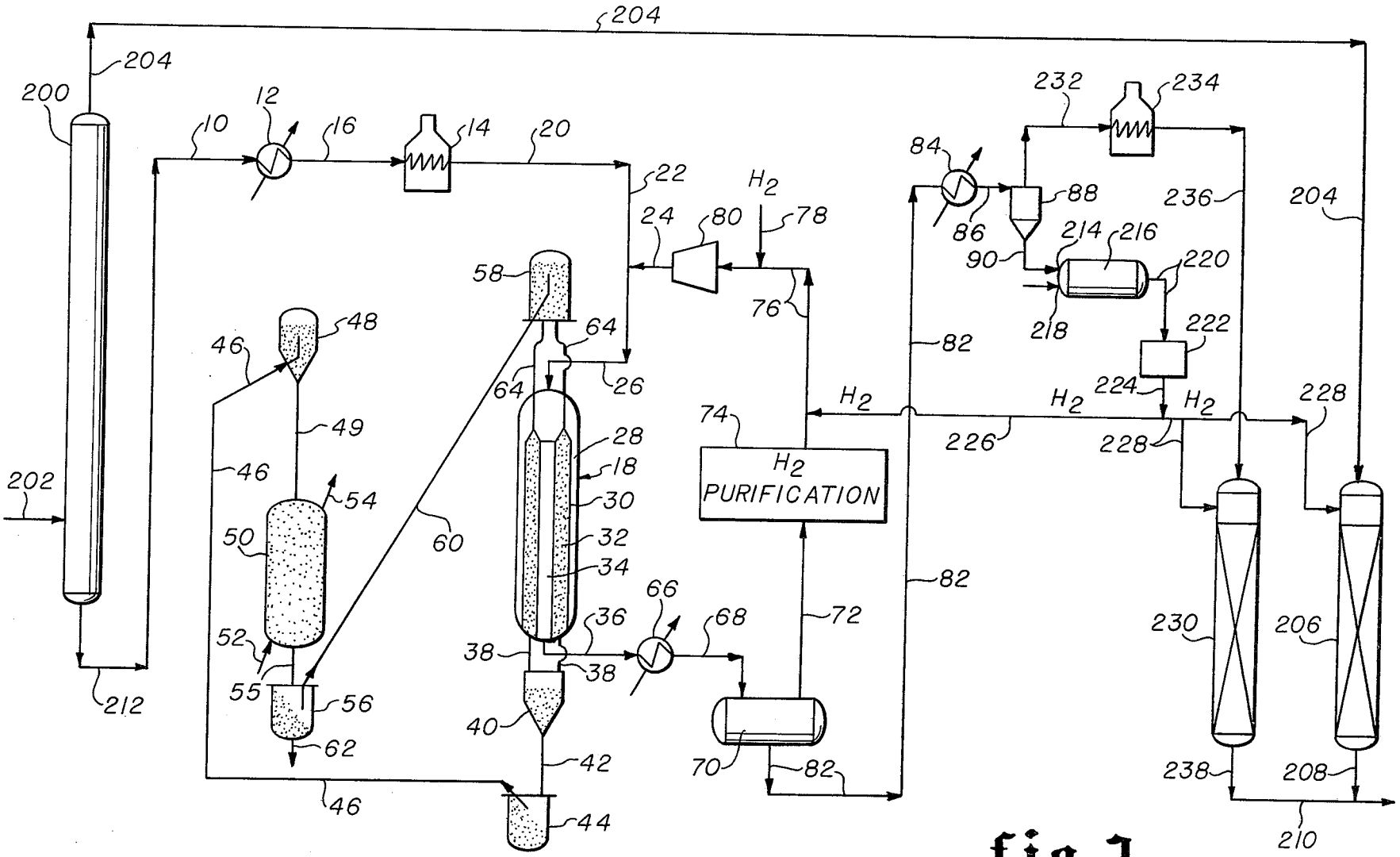
FIG. 2 is a schematic flow diagram of a second embodiment of the present invention illustrating the integration of a partial oxidation unit and hydrodesulfurization unit with the present process.

A conventional moving bed reactor with a closed-loop catalyst circulation system is disclosed in FIGS. 1 and 2. During the operation of the process of the present invention, the catalyst 32 utilized in reactor 18 is continuously circulated through the reactor and a regeneration unit outside the reactor 18. That is, catalyst is continuously withdrawn from the bottom of the reactor, circulated through a regeneration unit for regeneration for the catalyst, and then readmitted to the reactor at the top of the reactor. As depicted in FIG. 1, catalyst is withdrawn from the bottom of the catalyst cylinders 30 through lines 38, and the withdrawn catalyst is temporarily collected in a lower reactor hopper 40. From the hopper 40, the catalyst is passed through a line 42 to a lift pot 44 from which the catalyst is conveyed upwardly through line 46 to an upper regenerator hopper 48. The upper regenerator hopper 48 dispenses the catalyst through line 49 to a regenerator reactor 50. In the regenerator 50, the catalyst is contacted with an oxygen containing gas introduced through line 52 to burn off desired quantities of coke deposited on the catalyst in the pretreating zone. A flue gas exhaust line 54 is provided with reactor 50 to exhaust the combustion gases in an environmentally acceptable manner.

After regeneration, the catalyst is conveyed from reactor 50 through line 55 to a reactor lift pot 56. From the lift pot 56, the regenerated catalyst is conveyed upwardly to an upper reactor hopper 58 through line 60. The reactor lift pot 56 also had a discard valve 62 through which unwanted catalyst may be purged. However, the undiscarded catalyst in lift pot 54 is conveyed to the upper reactor hopper 58. The catalyst in the hopper 58 is admitted to the upper portion of the catalyst cylinders 30 through lines 64.

The rate at which catalyst is circulated through the pretreating reactor 18 and into the regenerator reactor 50 will vary according to this specific feedstock being processed. By way of example, however, it has been discovered that when Gach Saran atmospheric residuum is processed, the residence time of the catalyst in the pretreating reactor 18 is preferably from about 2.5 days to about 5.0 days when the feedstock is processed in reactor 18 at a liquid hourly space velocity of from about 0.15 $V_o/hr/V_c$ (volume of oil/hr/volume of catalyst) to about 1.0 $V_o/hr/V_c$. After such time, the catalyst is preferably regenerated. With Gach Saran atmospheric residumm being processed at a space velocity of about 0.15 to about 1.0 $V_o/hr/V_c$, the catalyst is preferably discarded through purge value 62 after about 35 to 60 days of contacting oil.

As previously noted, the feedstock mixed with hydrogen contacts the cracking catalyst 32 in reactor 18 at mild hydrocracking conditions. The temperature of reactor 18 is preferably maintained at temperatures of from about 750° F to about 850° F. The hydrogen partial pressure in the reactor 18, which is substantially the process pressure is from about 700 psig to about 3000 psig and preferably from about 800 psig to about 1000 psig. The liquid hourly flow rate of the feed through the reactor 18 can vary from about 0.1 $V_o/hr/V_c$ to about 2.0 $V_o/hr/V_c$, with the preferred range being from about 0.15 $V_o/hr/V_c$ to about 1.0 $V_o/hr/V_c$.

By comparing the metal content of the effluent in line 36 with the metal content of the heavy feedstock, it has been found that removal of vanadium and nickel in the pretreating zone is on the order of 90 to 98 percent. While talking in terms of vanadium and nickel, it should be understood that other metals, such as iron, copper, and the like which are present in minor amounts in the feedstock are also removed in the pretreating zone. Further, a comparison of the Conradson carbon residue contents of the heavy feedstock and of the treated effluent in line 36 show that a con carbon reduction on the order of 40 percent and higher is achieved in the pretreating zone.

However, the effluent of the pretreating zone is additionally upgraded by the separation of an asphaltic fraction from the pretreating zone effluent. As described in more detail below, the pretreating zone effluent is cooled, causing a sold asphaltic fraction to precipitate. The precise temperature to which the effluent must be cooled to achieve this precipitation will, of course, vary depending on the specific feedstock used. However, an illustrative examples of such temperatures are given below. Once precipitated, the asphaltic fraction can be removed by simple filtration or other convenient means to provide an even higher quality treated feedstock for subsequent refining processes.

Referring again to FIG. 1, the effluent of the pretreating zone is passed through line 36 to a heat exchanger 66. In the heat exchanger 66, the pretreating zone effluent is cooled to a temperature just above which the major precipitation of the asphaltic fraction will occur. When a Gach Saran atmospheric residuum, the pretreating zone effluent should be cooled to a temperature on the order of 600° F. After cooling, the effluent is passed through line 68 to a flash tank 70. In the flash tank, hydrogen and any hydrogen sulfide formed in the pretreating zone are removed from the effluent. The removed hydrogen and hydrogen sulfide are conveyed through a line 72 to a conventional purification unit 74. In the purification unit 74, hydrogen is separated from sulfur with a suitable scrubbing solution such as an amine, monoethanolamine, diethanolamine, or the like. The hydrogen thus separated is relatively pure recycle hydrogen which exits the purification unit 74 through a line 76. In the line 76, fresh makeup hydrogen from any suitable source (not shown) may be added through line 78. The hydrogen conveyed in line 76 is then supplied to a compressor 80. The compressor 80 brings the hydrogen to a pressure suitable for use in the pretreating zone and supplies the pressurized hydrogen to line 24 for mixing with feedstock in line 22 as previously described.

The liquid and any solid portion of the pretreating effluent is removed from flash tank 70 through a line 82. The effluent is passed to the heat exchanger 84 in which the effluent is cooled to a temperature sufficient to achieve substantial precipitation of the solid asphaltic fraction. When processing a Gach Saran atmospheric residuum, a suitable temperature to which the effluent may be cooled in heat exchanger 84 is on the order of 150° F. The cooled effluent is then passed from heat exchanger 84 through line 86 to any suitable means for separating solids and liquids. The separation device depicted in FIG. 1 is a hydraulic cyclone 88. It should be understood, of course, that replaceable filters or any other suitable, conventional solid-liquid separation device may be used in lieu of the hydraulic cyclone 88.

In separating the solid asphaltic fraction from the remaining portion of the effluent of the pretreating zone, some very heavy oils may be closely associated with the solid asphaltic fraction. To achieve a more complete separation of the solid asphaltic fraction and associated oils, they may be passed from the hydraulic cyclone 88 through line 90 to a settling tank 92. In the settling tank, the further cooling of the solid asphaltic fraction and oil associated therewith will occur, causing a continued precipitation and separation of the oils and solids. The solids may then be removed from the settling tank 92 by a line 94 and discarded, used as a fuel, or put to some other suitable purpose.

The oil thus separated from the solid asphaltic fraction in settling tank 92 is extracted through a line 96 and passed to a line 98 where the oil from the settling tank 92 and the liquid portion of the pretreating zone effluent withdrawn from hydraulic cyclone 88 are mixed.

The liquid effluent of the pretreating zone in line 98 is a very substantially upgraded feedstock having very low metals and con carbon contents. In addition, the effluent in line 98 has some final petroleum products such as gasoline, and mid-boiling range products. Accordingly, the effluent in line 98 is passed to a furnace 100 where the effluent is heated to a suitable temperature for fractionation. From the furnace 100, the effluent is passed through line 102 to fractionator 104. In the fractionator 104, the final petroleum products are separated from the upgraded feed. For example, gasoline may be obtained from fractionator line 106, mid-boiling range products from fractionator line 108 so that the upgraded, treated feedstock alone is available through fractionator line 110.

A second embodiment of the present invention is schematically depicted in FIG. 2. In the second embodiment, a partial oxidation step for producing hydrogen from the solid asphaltic fraction and a hydrodesulfurization step are integrated with the pretreating process described above.

For the second embodiment of the present invention, the heavy feedstock may be desalted in conventional units (not shown) and preheated prior to introduction to distillation column 200 via line 202. The very light products of the distillation are passed through line 204 to a hydrodesulfurization reactor 206. As described in more detail below, the hydrodesulfurization reactor 206 removes sulfur from the light hydrocarbon products from distillation unit 200 and passes the desulfurized light hydrocarbons through line 208 to a final product gathering line 210.

The heavier products from the distillation column 200 are passed through line 212 and introduced to the pretreating process heretofore described. Except otherwise noted, the pretreating process utilized in the second embodiment of the present invention is identical to the pretreating process employed in the first embodiment of the present invention. Accordingly, like numerals are used in FIGS. 1 and 2 to designate like elements of the pretreating process apparatus. Further, the process conditions of the pretreating process of the second embodiment are identical to the process conditions of the pretreating step of the first embodiment, and the above discussion of the pretreating process is incorporated hereby reference as applicable to the second embodiment of the present invention.

Briefly, the heavier products of the distillation step are passed through line 212 to line 10, through heat exchanger 12 and preheat furnace 14 to line 22 where the feedstock is mixed with hydrogen. The hydrogen and feedstock are then reacted in the pretreating zone reactor 18, and the treated feedstock exits reactor 18 through line 36. The effluent is then cooled in heat exchanger 66 and passed through line 68 to flash tank 70. In tank 70, gases are drawn off through line 72 to provide recycle hydrogen, and the liquid and any solid effluent is passed from the flash tank through line 82 to heat exchanger 84 in which the effluent is cooled to a temperature sufficient to precipitate a solid asphaltic fraction. The cooled feedstock is then passed to hydraulic cyclone 88 where the solid asphaltic fraction is separated from the liquid portion of the effluent.

In the second embodiment of the present invention, the solid asphaltic fraction is removed from hydraulic cyclone 88 through line 90 and passed to an inlet 214 of a partial oxidation furnace 216. An oxygen rich gas is also passed to the partial oxidation furnace 216 through a second furnace inlet 218. In the partial oxidation furnace 216, the solid asphaltic fraction is oxidized, and a resulting gas consisting of hydrogen, carbon dioxide, and carbon monoxide is discharged from furnace 216 through line 220. The gases discharged from furnace 216 through line 220 are then passed to a shift converter section of unit 222, carbon monoxide is converted to a carbon dioxide with an accompanying production of hydrogen. The entire gases are then passed to a hydrogen purification and consolidation section of unit 222 which separates hydrogen rich gases from other gases in the unit and removes the sulfur from the hydrogen gas with conventional scrubbing compounds. The resultant gas withdrawn from the shift converter and hydrogen purification unit 222 is a relatively pure hydrogen gas. The hydrogen is withdrawn from unit 222 through line 224 and conveyed through line 226 to line 76 where the hydrogen from the partial oxidation unit is combined with the recycle hydrogen for use in the pretreating zone. In addition, hydrogen from the partial oxidation unit passes through line 224 through line 228 which feeds the hydrogen to the hydrodesulfurization reactors 206 and 230.

The above described partial oxidation unit is conventional in nature and any other conventional partial oxidation unit may be used to generate the hydrogen. With any such partial oxidation unit, however, the added benefit is obtained of using the asphaltic fraction of the feedstock, the least desirable fraction, for producing a useful product and thereby increasing the economy of the process of the present invention.

Referring again to the hydraulic cyclone 88, in the second embodiment of the present invention the liquid portion of the pretreating zone effluent is withdrawn from the hydraulic cyclone 88 through a line 232 and conveyed to a furnace 234. In the furnace, the treated feedstock is heated to a temperature suitable for introduction into the hydrodesulfurization reactor 230. While this temperature will vary depending on the feedstock being processed and the extent of desulfurization required in reactor 230, an illustrative example of the temperature range to which the treated feedstock is heated in furnace 234 is on the order of about 650° F to about 900° F.

The treated feedstock is passed from furnace 234 through line 236 to hydrodesulfurization reactor 230. The hydrodesulfurization reactors 230 and 206 are both conventional in nature. Indeed, any conventional hydrodesulfurization process may be used with the second embodiment of the present invention. However, as specifically illustrated in FIG. 2, the hydrodesulfurization reactors 206 and 230 are fixed bed reactors containing a conventional hydrodesulfurization catalyst. For example, the catalyst may comprise Group VI and Group VII metals on a non-cracking support. Such catalysts are well known to those skilled in the art and need not be described further. The conditions in the hydrodesulfurization reactors are also conventional. An illustrative example of the conditions employed is a hydrogen partial pressure of from about 1000 to about 5000 psig with temperatures ranging from about 650° F to about 900° F. It should additionally be noted that the hydrodesulfurization reactor 230 may be operated at more severe conditions than hydrodesulfurization reactor 206 since the former is employed to remove sulfur from heavier hydrocarbons.

The desulfurization effluent from reactor 230 is passed through line 238 and into the final product gathering line 210. The effluent in the gathering line 210 contains some final petroleum products such as gasoline and mid-boiling range products. The remainder of the effluent in line 210 is a vastly upgraded feedstock having reduced metals. Conradson carbon residue, and sulfur contents. This upgraded feedstock is, therefore, very well suited for subsequent refining process such as heavy oil cracking or fluid catalytic cracking.

The practice of the process of the present invention will be further exemplified by the following examples which are provided for the purpose of illustration and not limitation.

EXAMPLES

Gach Saran atmospheric bottoms were selected as the petroleum feedstock to be processed for demonstrating the operation of the present invention. This feed was selected because of its substantial metals and con carbon content. The properties of this petroleum residuum are shown in Table I.

TABLE I

| Property | Gach Saran Atmospheric Bottoms |
|---|---|
| Gravity, ° API | 16.0 |
| Gravity, SpG 60° F/60° F | 0.960 |
| Flash Point, ° F | 264.0 |
| Viscosity, CS 122° F | 290.5 |
| Viscosity, CS 210° F | 29.3 |
| Con Carbon, Wt % | 9.4 |
| Asphaltenes (n-$C_7$), Wt % | 3.0 |
| Asphaltenes (n-$C_5$), Wt % | 6.0 |
| Sulfur, Wt % | 2.60 |
| Nitrogen (Total), Wt % | 0.38 |
| Nitrogen (Basic), Wt % | 0.10 |
| Metals, ppm | |
| Vanadium | 123.0 |
| Nickel | 43.0 |

Two identical testing units were used to process this feed. Each of the testing units featured a 1 inch Schedule 80 reactor having an actual measured inside diameter of 0.957 inches and an interior cross-sectional area of 0.715 square inches. Each reactor was vertically mounted in a three zoned furnace to provide external heat to the reactor, and thermocouples were used to measure the temperature of the catalyst bed. Oil was pumped to reactor pressure by a metering pump, mixed with hydrogen, and fed to the top of the reactor. To permit feeding of the viscous feedstock, the feed reservoir was heated by heat lamps and the feedline was hot water traced. Facilities were provided for metering hydrogen gas at 1000 psig. A high pressure separator system was used to collect the liquid product. Hot water tracing was extended to product recovery coolers and a liquid product receiver which was maintained at between 120° F and 140° F. Product gas was sampled, scrubbed and metered before flaring.

As set forth in more detail below, catalysts used to demonstrate the operability of the present invention were equilibrated Filtrol 900 fluid catalytic cracking catalysts obtained from two different commercial refining units. The first of these commercial units is an HOC unit, and the catalyst obtained from this unit is hereinafter referred to as the HOC catalyst. The other commercial refining unit from which catalyst was obtained is a gas oil cracking unit. A portion of the catalyst from this latter unit was artifically impregnated with vanadium and nickel, and that catalyst is hereinafter referred to as the impregnated gas oil catalyst. Another portion of the catalyst from the gas oil cracker was utilized without metals impregnation and the unimpregnated catalyst is hereinafter referred to simply as the gas oil catalyst.

All catalysts utilized in the examples set forth below were sulfided before being contacted with feedstock. In order to sulfide the catalyst, N-butyl mercaptan in gas oil (5 cc mercaptan per 1000 cc of oil) was used. Sulfiding was carried out at 800° F under 850 psig hydrogen pressure.

At various times indicated below, each of the catalysts used was regenerated. The catalyst was withdrawn from the pretreatment reactor, placed in a one-inch diameter quartz tube in a vertical heating furnace, and heated to 1100° F while a stream of nitrogen was passed over the catalyst. The oxygen content of the nitrogen gas was gradually increased until the oxygen and nitrogen proportions were about the same as in air. The heating was continued very carefully to remove carbon from the catalyst surface.

Initial runs demonstrating the operation of the present invention employed the HOC catalyst. The equilibrated HOC catalyst contained 0.33 wt. % nickel and 0.53 wt. % vanadium. This catalyst was formed into tablets having a 3/32 inch diameter and a length of one-eighth inch. The tableted catalyst was employed in both an initial screening test and an aging test, the details of which are set forth in my copending application on an "Integrated Process for Converseion of Petroleum Residuum Streams", Ser. No. 729,528, filed Nov. 4, 1976, which is incorporated herein by reference. Suffice it to say here that metals removal in the initial stages of the aging test was good, but metals removal declined as the time of catalyst exposure to oil increased. For example, at the start of the aging test, vanadium removal was 97.6% and nickel removal was 79.1%, but after about 320 total hours of processing, vanadium removal declined to 64.2% and nickel removal to 48.8%.

After noting the decline, it was decided to regenerate the aging test HOC catalyst, recharge it to the pretreating reactor, and make an additional run (herein referred to as Run A) to see if the regeneration would restore the metals removing activity of the HOC catalyst. Accordingly, the catalyst was regenerated and then inspected. The results of the catalyst inspection prior to Run A are set forth in Table II, along with the results of catalyst inspections prior to each of the other runs described below. Details concerning the catalyst pack in which the catalyst with inerts was charged to the pretreating reactor and regenerations of the catalyst are shown in Table III for each of the runs described herein, including Run A.

TABLE II

| CATALYST | ←HOC→ | | | ←GAS OIL→ | | | | IMPREG. ←GAS OIL→ | | |
|---|---|---|---|---|---|---|---|---|---|---|
| RUN NO. | A | B | C | D | E | F | G | H | I | J |
| NO. OF REGENERATIONS | 1 | 2 | 2 | 0 | 1 | 2 | 3 | 0 | 1 | 2 |
| PHYSICAL PROPERTIES | | | | | | | | | | |
| Sa $m^2$/gm | 54 | 56 | — | 96 | 69 | 86 | 78 | 10 | 5 | 48 |
| BULK DENSITY IN REACTOR gm/cc | 0.96 | 0.96 | — | 0.90 | 0.88 | 0.89 | 0.94 | 0.82 | 0.84 | 0.86 |
| PARTICLE SIZE, in. | | | | ←3/32"ϕ × 1/8" long→ | | | | | | |
| CHEMICAL COMPOSITIONS | | | | | | | | | | |
| VANADIUM WT% | 1.08 | 1.09 | 1.14 | 0.022 | 0.24 | 0.58 | 0.85 | 1.08 | 1.56 | 2.19 |
| NICKEL WT% | 0.56 | 0.53 | 0.50 | 0.024 | 0.09 | 0.18 | 0.24 | 0.44 | 0.63 | 0.75 |
| IRON WT% | — | — | — | — | 0.31 | — | 0.50 | — | — | — |
| SODIUM WT% | — | — | — | — | 0.38 | — | 0.57 | — | — | — |
| CARBON WT% | 0.19 | 0.21 | 16.3 | 1.94 | 1.40 | 0.29 | 0.22 | 0.98 | 1.14 | 0.27 |

TABLE III

HOC CATALYST

| RUN NO. | ←A→ | | | | | ←B→ | | | | | | ←C→ | | | |
|---|---|---|---|---|---|---|---|---|---|---|---|---|---|---|---|
| CHARGE OR DUMP | C | | D | C | | D | C | | D | C | | D | C | | D |
| DATE 1975 | 10/20 | | 11/5 | 11/7 | | 11/10 | 11/10 | | 11/13 | 11/22 | | 12/2 | 12/3 | | 12/7 |
| | Inches | Gms | Gms | | | | | | | | | | | | |
| TOP ALUMINA CYL. 1/4" × 1/4" | 11 | 208 | 230 | 12 | 230* | 233 | 12– | 204* | 202 | 12 | 246** | 245 | 12 | 211* | 212 |
| CATALYST PELLETS-3/32" ϕ × 1/8" | 8 | 85 | 98 | 7 | 8 | 94 | 7+ | 93 | 92 | 7 | 89 | 89 | 7– | 89 | 89 |
| BTM. ALUMDUM CHIPS - 6 - MESH | 7 | 134 | 133 | 8 | 153 | 162 | 8 | 191 | 194 | 8 | 174 | 168 | 7+ | 140* | 141 |
| BTM ALUMINA RING - 1/4 rd | 2 | 23 | 22 | 2 | 18 | 22 | 2 | 22 | 19 | 2 | 25 | 31 | 3– | 31*25 | |
| TOTAL REACTOR | 28 | 450 | 483 | 29 | 481 | 511 | 29 | 510 | 507 | 29 | 534 | 533 | 29 | 471 | 467 |
| FINES (DUMPED)[1] - GMS | 2 | | — | | | — | | | 2 | | | 12 | | | 4 |
| | R | | | R | | | | | | | | | | | |

GAS OIL CATALYST

| RUN NO. | | ←D→ | | ←E→ | | | | | | ←F→ | | | | | | ←G→ | | |
|---|---|---|---|---|---|---|---|---|---|---|---|---|---|---|---|---|---|---|
| CHARGE OR DUMP | C | | D | C | | D | C | | D | C | | D | C | | D | C | | D |
| DATE 1975 | 10/23 | | 11/7 | 11/9 | | 11/17 | 11/19 | | 11/21 | 11/21 | | 11/26 | 12/2 | | 12/7 | 12/8 | | 1/5 |
| | Inches | Gms | Gms | | | | | | | | | | | | | | | |
| TOP ALUNDUM CHIPS 6-8 MESH | 1 | 18 | 18 | 1+ | 29 | 30 | 3– | 64 | Below | 2 | 48* | 48 | 3– | 63* | 50 | 4 | 78 | Below |
| CATALYST PELLETS-3/32" ϕ × 1/8" | 22 | 225 | 269 | 22– | 217 | 281 | 20+ | 205 | 245 | 20 | 243 | 245 | 19– | 245 | 246 | 18 | 192 | 222 |
| BTM ALUNDUM CHIPS - 6-8 Mesh | 4 | 76 | 78 | 4 | 79 | 81 | 4 | 79 | 143 | 5 | 95* | 95 | 5 | 95* | 97 | 5 | 96 | 174 |
| BTM ALUMINA RING - 1/4 rd | 2 | 24 | 26 | 2 | 21 | 25 | 2 | 33 | 36 | 2 | 25 | 28 | 2+ | 28* | 29 | 2 | 26 | 32 |
| TOTAL REACTOR | 29 | 343 | 391 | 29 | 346 | 417 | 29 | 281 | 424 | 29 | 411 | 416 | 29 | 421 | 4 | 29 | 392 | 428 |
| FINES (DUMPED)[1] - GMS | | | — | | | 2 | | | 12 | | | 13 | | | | | | 3 |
| | | | | R | | | R | | | | | | | | | R | | |

IMPREG. GAS OIL CATALYST

| RUN NO. | ←H→ | | | ←I→ | | | | | ←J→ | | | |
|---|---|---|---|---|---|---|---|---|---|---|---|---|
| | C | | D | C | | D | C | | D | C | | D |
| DATE 1976 | 1/24 | | 1/31 | 2/4 | | 3/18 | 3/21 | | 3/31 | 4/3 | | |
| | Inches | Gms | Gms | | | | | | | | | |
| TOP ALUNDUM CHIPS - 6-8 MESH | 3– | 46* | 41 | 4– | 11* | 59 | 3– | 59* | 27 | 3 | 27* | 40 |
| CATALYST PELLETS-3/32" ϕ × 1/8"L | 21+ | 197 | 226 | 19+ | 184 | 253 | 18– | 173 | 235 | 18– | 235 | |
| | | | | | | | | | | | 248 | |
| BTM ALUNDUM CHIPS - 6-8 MESH | 3 | 64* | 64 | 4+ | 91* | 95 | 6+ | 131* | 139 | 6+ | 139* | 142 |
| BTM ALUMINA RING - 1/4 rd | 2 | 26* | 26 | 2 | 26* | 27 | 2 | 27* | 27 | 2 | 27* | 28 |
| TOTAL REACTOR | 29 | 333 | 357 | 29 | 372 | 434 | 29 | 390 | 428 | 29 | 428 | 458 |
| FINES (DUMPED)[1] - GMS | | | 16 | | | 21 | | | — | | | 15 |
| | | | | R | | | R | | | | | |

NOTES:
(1)Fines include coke, broken chips, and catalyst pellets
(2)R indicates regeneration prior to charging
(*)Used inerts charged
(**)Of this 246 gms, 53 gms were fresh The results of Run A are shown in Table IV. As can be seen from that table, very good metals removal and con carbon reduction was obtained with the regenerated HOC catalyst. However, it was decided to investigate the metals removing activity of the inerts used in the Run A catalyst pack to substantiate that restoration of metals removal in Run A was due in large part to regeneration rather than any metals removing capability of the fresh inerts in the catalyst pack of Run A. Accordingly, a run was conducted using only inerts in the pretreating reactor. The results of this blank run indicated high initial metals removing activity, but after only about 40 hours on oil, the vanadium and nickel removal dropped to 18% and nil, respectively. Thus, the inerts metal removing activity decreased rapidly with time on oil.

Two additional runs were made with the HOC catalyst in a manner which should reduce the effect of the inerts. The HOC catalyst of Run A was again regenerated and recharged to the pretreating reactor with inerts, some of which were used inerts from Run A. Due to the time in oil of the inerts, their metals removing activity should be limited. Runs B and C were then carried out with this twice regenerated HOC catalyst. The results of these runs shown in Table IV indicate excellent metals removal and con carbon reduction as well as a reduction in the sulfur content of the petroleum feedstock.

Additional experiments were run in a like manner to investigate the variables to temperature and liquid hourly space velocity. As anticipated, substantial increase in space velocity resulted in poorer metals removal. At temperatures of about 850° F. the feed caused extensive coking in the reactor, and at temperatures lower than 750° F unsatisfactory metal removal from the feed resulted, indicating that preferred temperature for processing Gach Saran atmospheric bottoms with the present invention is from about 750° F to about 850° F.

TABLE IV

| RUN NO. | | | ←A→ | | | | | ←B→ | | | | ←C→ | | |
|---|---|---|---|---|---|---|---|---|---|---|---|---|---|---|
| PERIOD NUMBER | 2 | 5 | 8 | 9 | 10 | 2 | 3 | 5 | 7 | 3 | 6 | 10 | 12 | 14 |
| TIME ON OIL, HOURS | 12 | 36 | 55 | 63 | 70 | 12 | 20 | 39 | 55 | 103 | 127 | 158 | 174 | 190 |
| TOTAL TREATING HOURS | 349 | 373 | 392 | 400 | 407 | 422 | 430 | 449 | 465 | 513 | 537 | 568 | 584 | 600 |
| OPERATING CONDITIONS | | | | | | | | | | | | | | |
| Reactor Temp., ° F | 800 | 800 | 800 | 800 | 800 | 800 | 800 | 800 | 800 | 800 | 800 | 800 | 800 | 800 |
| Reactor Pressure, PSIG | 850 | 850 | 850 | 850 | 850 | 850 | 850 | 850 | 850 | 850 | 850 | 850 | 850 | 850 |
| LHSV, cc/hr/cc | 0.18 | 0.22 | 0.16 | 0.20 | 0.23 | 0.24 | 0.24 | 0.24 | 0.21 | 0.20 | 0.20 | 0.19 | 0.19 | 0.19 |
| Oil Rate, gm/hr | 15.2 | 18.4 | 13.6 | 16.5 | 19.6 | 19.0 | 19.1 | 19.5 | 17.0 | 15.8 | 15.6 | 15.5 | 15.2 | 15.2 |
| $H_2$Rate, SCFH | ←Approximately 0.56 SCFH→ | | | | | 0.514 | 0.514 | 0.525 | — | 0.519 | 0.504 | 0.504 | 0.504 | 0.504 |
| PRODUCTS | | | | | | | | | | | | | | |
| Liquid Product Analysis | < | | | | | | | | | | | | | |
| Vanadium wppm | <<1 | 2 | 1 | 1 | <1 | <1 | 1 | <1 | <1 | 5 | 4 | <1 | 4 | |
| Nickel, wppm | 1 | 1 | 4 | <1 | 3 | <1 | <1 | 2 | 1 | 3 | 5 | 3 | 2 | 7 |
| Sulfur, wt% | 0.76 | 1.42 | 0.86 | 1.21 | 1.50 | 1.46 | 1.54 | 1.49 | 1.60 | 1.77 | 1.96 | 1.89 | 1.91 | 1.96 |
| Con Carb. Res., wt% | 0.10 | 1.34 | — | 0.38 | — | 0.64 | — | — | 2.27 | 2.07 | — | 3.78 | 3.01 | — |
| CALCULATED RESULTS | | | | | | | | | | | | | | |
| $H_2$ Consumed, SCF/B | — | — | — | — | — | 509 | 402 | 534 | — | 252 | 186 | 355 | 481 | — |
| HC in Gas, wt% F.F. | 5.3 | 4.4 | — | 4.3 | — | 3.8 | 4.2 | 4.9 | — | 4.0 | 3.8 | 2.5 | — | — |
| Vanadium Removal, % | >99.2 | >99.2 | 98.4 | 99.2 | 99.2 | >99.2 | >99.2 | 99.2 | >99.2 | >99.2 | 95.9 | 96.7 | >99.2 | 96.7 |
| Nickel Removal, % | >97.6 | >97.6 | 90.5 | 97.6 | 92.9 | >97.6 | >97.6 | 95.2 | 97.6 | 92.9 | 88.1 | 92.9 | 95.2 | 83.3 |
| Sulfur Removal, % | 69.8 | 43.6 | 65.9 | 52.0 | 40.5 | 42.1 | 38.9 | 40.9 | 36.5 | 29.8 | 22.2 | 25.0 | 24.2 | 22.2 |
| Con Carb Removal, % | 98.9 | 85.7 | — | 95.9 | — | 93.2 | — | — | 75.9 | 78.0 | — | 59.8 | 68.0 | — |

The second catalyst used to demonstrate the operation of the present invention was the gas oil catalyst. As shown in Table II, this catalyst had a very low initial metals content. The catalyst was tableted and charged to the pretreating zone reactor for Run D indicated in Table IV. Run D was then conducted. Thereafter, the gas oil catalyst was used in Runs E, F, and G with catalyst regeneration being carried out after Runs D, E, and F. The results of Runs D, E, F, and G shown in Table V illustrate that the metal removing activity of the catalyst improves with in situ deposition of feedstock metals on the catalyst and regeneration restores a substantial portion of the metals removing activity of the catalyst.

TABLE V

| RUN NO. | | ←D→ | | | | ←E→ | | | | | ←F→ | | | | | ←G→ | |
|---|---|---|---|---|---|---|---|---|---|---|---|---|---|---|---|---|---|
| PERIOD NUMBER | 2 | 7 | 11 | 15 | 3 | 5 | 9 | 14 | 3 | 6 | 9 | 12 | 15 | 3 | 5 | 7 | 8 |
| TIME ON OIL HOURS | 12 | 52 | 84 | 116 | 20 | 36 | 68 | 108 | 26 | 46 | 70 | 94 | 118 | 20 | 36 | 52 | 60 |
| TOTAL TREATING HOURS | 12 | 52 | 84 | 116 | 140 | 156 | 188 | 228 | 260 | 280 | 304 | 328 | 352 | 376 | 392 | 408 | 416 |
| OPERATING CONDITIONS | | | | | | | | | | | | | | | | | |
| Reactor Temp., ° F | 800 | 800 | 800 | 800 | 800 | 800 | 800 | 800 | 800 | 800 | 800 | 800 | 800 | 800 | 800 | 800 | 800 |
| Reactor Pressure, PSIG | 850 | 850 | 850 | 850 | 850 | 850 | 850 | 850 | 850 | 850 | 850 | 850 | 850 | 850 | 850 | 850 | 850 |
| LHSV, cc/hr/cc | 0.18 | 0.19 | 0.19 | 0.19 | 0.19 | 0.19 | 0.19 | 0.20 | 0.22 | 0.23 | 0.18 | 0.20 | 0.20 | 0.22 | 0.22 | 0.22 | 0.21 |
| Oil Rate, gm/hr | 44.6 | 46.0 | 45.6 | 46.8 | 46.2 | 45.9 | 44.8 | 47.0 | 48.7 | 51.0 | 40.6 | 43.3 | 43.3 | 42.6 | 43.4 | 43.4 | 41.0 |
| $H_2$ Rate, SCFH | — | 1.530 | 1.530 | 1.543 | 1.494 | 1.499 | — | — | 1.500 | 1.432 | 1.437 | 1.437 | 1.437 | 1.412 | 1.440 | — | 1.467 |
| PRODUCTS | | | | | | | | | | | | | | | | | |
| Liquid Product Analysis | | | | | | | | | | | | | | | | | |
| Vanadium, wppm | <1 | 11 | 10 | 20 | <1 | 2 | 7 | 21 | 13 | 22 | 39 | 24 | 21 | 2 | 4 | 4 | 8 |
| Nickel, wppm | <1 | 13 | 19 | 19 | <1 | 7 | 11 | 20 | 20 | 27 | 20 | 21 | 21 | 7 | 5 | 5 | 12 |
| Sulfur, wt% | 1.57 | 1.83 | 1.78 | 1.87 | 1.67 | 1.75 | 1.88 | 2.05 | 2.11 | 2.12 | 2.14 | 2.14 | 2.12 | 1.77 | 1.74 | 1.82 | 1.80 |
| Con Carb. Res., wt% | 3.18 | 6.15 | — | 5.85 | 4.70 | — | 6.19 | — | 5.37 | 6.11 | 6.05 | — | 7.03 | 4.26 | 4.69 | — | 4.98 |
| CALCULATED RESULTS | | | | | | | | | | | | | | | | | |

TABLE V-continued

| RUN NO. | ←D→ | | | | ←E→ | | | | ←F→ | | | | | ←G→ | | | |
|---|---|---|---|---|---|---|---|---|---|---|---|---|---|---|---|---|---|
| PERIOD NUMBER | 2 | 7 | 11 | 15 | 3 | 5 | 9 | 14 | 3 | 6 | 9 | 12 | 15 | 3 | 5 | 7 | 8 |
| $H_2$ Consumed, SCF/B | — | 498 | 130 | 740 | 198 | 216 | — | — | 144 | 323 | 338 | 786 | 257 | 322 | 342 | — | 372 |
| HC in Gas, wt% F.F. | — | 2.8 | 2.8 | 2.9 | 3.0 | 3.9 | — | — | 2.8 | 2.4 | 5.1 | 2.6 | 2.1 | 4.5 | 3.7 | — | 2.9 |
| Vanadium Removal, % | >99.2 | 91.0 | 91.8 | 83.6 | >99.2 | 98.5 | 94.3 | 82.8 | 89.3 | 82.0 | 68.0 | 80.3 | 82.8 | 98.4 | 96.7 | 96.7 | 93.4 |
| Nickel Removal, % | >97.6 | 69.0 | 54.8 | 54.8 | >97.6 | 83.3 | 73.8 | 52.4 | 52.4 | 35.7 | 52.4 | 50.0 | 50.0 | 83.3 | 88.1 | 88.1 | 71.4 |
| Sulfur Removal, % | 37.7 | 27.4 | 29.4 | 25.8 | 33.7 | 30.6 | 30.6 | 25.4 | 18.7 | 16.3 | 15.9 | 15.1 | 15.9 | 29.8 | 31.0 | 27.8 | 28.6 |
| Con Carb Removal, % | 66.2 | 34.6 | — | 37.8 | 50.0 | — | 34.2 | — | 42.9 | 35.0 | 35.6 | — | 25.2 | 54.7 | 50.1 | — | 47.0 |

The third catalyst used to demonstrate the operation of the present invention was the impregnated gas oil catalyst. The catalyst was impregnated in its powder form with vanadium and nickel. A vanadium naphtenate solution dissolved in benezene and a nickel naphthenate dissolved in benezene were used to impregnate the catalyst. The impregnation with these solutions was followed by drying and air calcination.

The impregnated catalyst was then tabletted and analyzed. The analysis showed that the impregnated catalyst contained 0.44 wt. % nickel and 1.08 wt. % vanadium.

A first run with the impregnated catalyst yielded an initial vanadium and nickel removal of 99.2% and 97.6% and a con carbon reduction of 66.2%. However, after 116 hours on oil, vanadium, nickel and con carbon reduction had declined to 83.6%, 54.8%, and 37.8%, respectively. Thereafter, the catalyst was regenerated, and Runs H, I and J were conducted using the same impregnated gas oil catalyst. The catalyst was regenerated after Runs G and H. The results of Runs H, I, and J are shown in Table VI. It can be seen from these results that the impregnated gas oil catalyst was almost equivalent to the HOC catalyst. Thus, a low metals containing, equilibriated fluid catalytic cracking catalyst can be advantageously used in the present invention. Such a catalyst will acquire a higher metals content through in situ deposition of feedstock metals on the catalyst and thereby improve its metals removing activity.

The results set forth above for each of the catalysts clearly indicate that the effluent of the pretreating zone contains a substantially upgraded feedstock due to its reduced metals, con carbon, and sulfur contents. However, it is also the practice of the present invention to even further upgrade the feedstock by cooling the pretreating zone effluent to precipitate a solid asphaltic fraction and separating out the solid asphaltic fraction by conventional solid-liquid separation means.

TABLE VI

| RUN NO. | ←H→ | | | | | ←I→ | | | | | | | | | ←J→ |
|---|---|---|---|---|---|---|---|---|---|---|---|---|---|---|---|
| PERIOD NUMBER | 3 | 6 | 9 | 12 | 15 | 3 | 6 | 9 | 12 | 15 | 19 | 21 | 26 | 3 | 6 |
| TIME ON OIL, HOURS | 18 | 42 | 66 | 90 | 114 | 20 | 44 | 68 | 92 | 116 | 148 | 164 | 197 | 20 | 44 |
| TOTAL TREATING HOURS | 18 | 42 | 66 | 90 | 114 | 150 | 174 | 198 | 222 | 246 | 278 | 294 | 327 | 446 | 470 |
| OPERATING CONDITIONS | | | | | | | | | | | | | | | |
| Reactor Temp., ° F | 800 | 800 | 800 | 800 | 800 | 800 | 800 | 800 | 800 | 800 | 800 | 800 | 800 | 800 | 800 |
| Reactor Pressure, PSIG | 850 | 850 | 850 | 850 | 850 | 850 | 850 | 850 | 850 | 850 | 850 | 850 | 850 | 850 | 850 |
| LHSV, cc/hr/cc | 0.20 | 0.20 | 0.20 | 0.20 | 0.20 | 0.18 | 0.19 | 0.19 | 0.19 | 0.19 | 0.18 | 0.19 | 0.19 | 0.20 | 0.19 |
| Oil Rate, gm/hr | 45.9 | 46.2 | 46.2 | 47.0 | 46.3 | 38.0 | 40.2 | 39.6 | 39.4 | 39.4 | 38.2 | 40.4 | 39.2 | 37.6 | 36.9 |
| $H_2$ Rate, SCFH | 1.481 | — | 1.481 | — | — | 1.268 | 1.281 | 1.261 | 1.285 | 1.249 | — | — | — | 1.143 | 1.143 |
| PRODUCTS | | | | | | | | | | | | | | | |
| Liquid Product Analysis | | | | | | | | | | | | | | | |
| Vanadium, wppm | 1 | 3 | 7 | 8 | 9 | <1 | 5 | 6 | 8 | 5 | 9 | 8 | 17 | <1 | 1 |
| Nickel, wppm | 1 | 4 | 9 | 9 | 11 | 1 | 5 | 10 | 12 | 13 | 11 | 6 | 16 | <1 | 4 |
| Sulfur, wt% | 1.48 | 1.53 | 1.88 | 1.66 | 1.98 | 1.60 | 1.70 | 1.86 | 1.81 | 1.81 | 1.73 | 1.70 | 1.80 | 1.29 | 1.43 |
| Con Carb. Res., wt% | 3.25 | 4.45 | 5.42 | 5.08 | 5.43 | 3.66 | 4.76 | 5.06 | 4.61 | 4.77 | — | 4.80 | 5.45 | 3.11 | 4.05 |
| CALCULATED RESULTS | | | | | | | | | | | | | | | |
| $H_2$ Consumed, SCF/B | 580 | — | 393 | — | — | 664 | 501 | 519 | 499 | 528 | — | — | — | 974 | 409 |
| HC in Gas, wt% F.F. | 3.3 | — | 3.0 | 2.8 | — | 3.4 | 4.3 | 8.4 | 3.7 | 4.5 | — | — | — | 15.1 | 4.4 |
| Vanadium Removal, % | 99.2 | 97.5 | 94.3 | 93.4 | 92.6 | >99.2 | 95.9 | 95.1 | 93.4 | 95.9 | 92.6 | 93.4 | 86.1 | >99.2 | 99.2 |
| Nickel Removal, % | 97.6 | 90.5 | 78.6 | 78.6 | 73.8 | 97.6 | 88.1 | 76.2 | 71.4 | 69.0 | 73.8 | 85.7 | 61.9 | >97.6 | 90.5 |
| Sulfur Removal, % | 41.3 | 39.3 | 25.4 | 34.1 | 21.4 | 36.5 | 32.5 | 26.2 | 28.2 | 28.2 | 31.3 | 32.5 | 28.6 | 48.8 | 43.2 |
| Con Carb Removal, % | 65.4 | 52.7 | 42.3 | 46.0 | 42.2 | 61.1 | 49.4 | 46.2 | 51.0 | 49.2 | — | 48.9 | 42.0 | 66.9 | 56.9 |

To demonstrate the separation of the solid asphaltic fraction from the effluent of the pretreating zone, a blend of thirteen samples of the pretreating zone effluent processed over the HOC catalyst was filtered at room temperature and under a mild vacuum through a Gelman Metricel filter media having a pore size of 1.2 μ. A solid and a liquid were obtained, both of which were treated with isopentane. The solid asphaltenes obtained from the isopentane treatment were further treated with trichloroethylene. Table VII schematically illustrates the treating steps and results obtained for the pretreating zone effluent. As can be seen from the table, the solid asphaltic fraction separated from the preheating zone effluent was rich in asphaltenes, and some heavy metals closely complexed with the asphaltic fraction were also removed by the separation.

TABLE VII

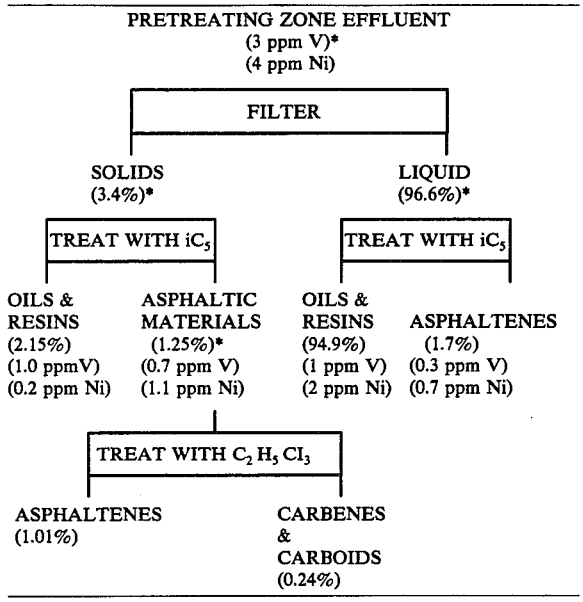

*ALL METALS CONTENTS AND PERCENTAGES UPON BASIS OF TOTAL EFFLUENT.

To determine the temperature at which the solid asphaltic fraction would precipitate from the pretreating zone effluent, a large number of samples of the effluent were mixed and portions of the mixture were filtered at various temperatures. The filtration step was conducted under a mild vacuum with a Gelman Metrical filter media having a pore size of 1.2$\mu$. The results of the filtration at three specific temperatures is shown in Table VII.

TABLE VIII

| Effluent Temperature (° F) | Total Solids (%) |
|---|---|
| 400 | 1.2 |
| 310 | 1.8 |
| 130 | 2.8 |

Extrapolation of these data indicates that with Gach Saran atmospheric bottoms as a feedstock, the asphaltic fraction begins to precipitate from the pretreating zone effluent at approximately 600° F, and at about 150° F filteration of the effluent results in separation of a large portion of the asphaltic fraction as a solid.

The foregoing examples illustrate the effectiveness of the present invention and are offered for purposes of illustration and not limitation. One of the ordinary skill in the art considering the foregoing description of this invention would be led to many modifications thereof without departing from the scope and intent of the appended claims.

I claim:

1. A process for upgrading a petroleum feedstock having at least 5 ppm metals and a Conradson carbon residue of from about 2.0 weight percent to about 25.0 weight percent, comprising the steps of:

(a) contacting the feedstock in a mild hydrocracking zone in the presence of 700 to 3000 psig partial pressure of hydrogen at a temperature of from about 750° F to about 850° F with a cracking catalyst;

(b) separating the mildly hydrocracked feedstock from the cracking catalyst;

(c) cooling the mildly hydrocracked feedstock to a temperature below about 600° F to precipitate a solid asphaltic fraction from the mildly hydrocracked feedstock; and (d) separating the solid asphaltic fraction from the mildly hydrocracked feedstock so that the portion of the mildly hydrocracked feedstock remaining after separation of the asphaltic fraction is a substantially upgraded feedstock.

2. The process of claim 1, wherein said step of separating the solid asphaltic fraction includes:

filtering the solid asphaltic fraction from the mildly hydrocracked feedstock.

3. The process of claim 1, wherein:

said separation of the solid asphaltic fraction is accomplished using hydraulic cyclones.

4. The process of claim 1, further including:

regenerating the cracking catalyst by contacting the catalyst at elevated temperatures with an oxygen containing gas for a time sufficient to reduce the carbon content of the catalyst; and returning the regenerated catalyst to the mild hydrocracking zone.

5. The process of claim 1, wherein at least one moving bed reactor is used for step (a) and further including:

removing portions of the cracking catalyst from the bottom of the bed of the reactor;

regenerating the cracking catalyst by contacting the catalyst at elevated temperatures with an oxygen containing gas for a time sufficient to reduce the carbon content of the catalyst; and adding the regenerated catalyst to the top of the bed of the reactor.

6. The process of claim 1, further including:

partially oxidizing the separated solid asphaltic fraction to produce hydrogen.

7. The process of claim 6, further including:

utilizing at least a portion of the hydrogen of said partial oxidation step as at least a portion of the hydrogen for step (a).

8. The process of claim 1, further including, subsequent to step (d):

contacting the liquid portion of the mildly hydrocracked feedstock in a hydrodesulfurization zone in the presence of 1000 psig to 5000 psig partial pressure of hydrogen at a temperature of from about 600° F to about 900° F with a desulfurization catalyst.

9. The process of claim 8, further including:

partially oxidizing the separated solid asphaltic fraction to produce hydrogen; and utilizing at least a portion of the hydrogen from said partial oxidation step as at least a portion of the hydrogen in the hydrodesulfurization zone.

10. The process of claim 1, further including: removing hydrogen from the effluent of the mild hydrocracking zone; and utilizing at least a portion of the removed hydrogen as at least a portion of the hydrogen for step (a).

11. The process of claim 1, wherein:

the temperature in the mild hydrocracking zone is from about 775° F to about 825° F.

12. The process of claim 1, wherein:

the hydrogen partial pressure in the mild hydrocracking zone is from about 800 psig to 1000 psig.

* * * * *